United States Patent [19]

Wilson

[11] 4,146,468

[45] Mar. 27, 1979

[54] APPARATUS AND METHOD OF CLASSIFYING SOLIDS AND LIQUIDS

[76] Inventor: George E. Wilson, 4212 N. River Way, Sacramento, Calif. 95825

[21] Appl. No.: 799,991

[22] Filed: May 24, 1977

[51] Int. Cl.[2] ..... B04C 3/00

[52] U.S. Cl. ..... 209/211; 210/84; 210/512 R

[58] Field of Search ..... 209/211; 210/512 R, 210/84, 304

[56] References Cited

U.S. PATENT DOCUMENTS

| | | | |
|---|---|---|---|
| 1,669,820 | 5/1928 | Grant et al. | 209/211 |
| 2,308,670 | 1/1943 | Bolton | 210/512 R |
| 2,330,423 | 9/1943 | Hart | 209/211 |
| 3,285,422 | 11/1966 | Wiley | 209/211 X |

*Primary Examiner*—Ralph J. Hill
*Attorney, Agent, or Firm*—Lothrop & West

[57] ABSTRACT

Liquid-solid separator in which the materials to be separated are introduced tangentially into a right circular cylindrical vessel including a substantially flat bottom with an opening in the center. The flow velocity is such that the suspended material accumulates in the center of the flat bottom and exits through the opening therein. A quiescent chamber receives the material issuing through the opening. A centrally located top outlet opening removes excess liquid. The apparatus may be operated so that a free vortex is obtained and material is separately removed from the core of the free vortex. The apparatus may also be operated so that material located adjacent the bottom may be removed from orbits determined by the specific gravity and settling velocity of the material relative to the liquid flow velocity.

9 Claims, 15 Drawing Figures

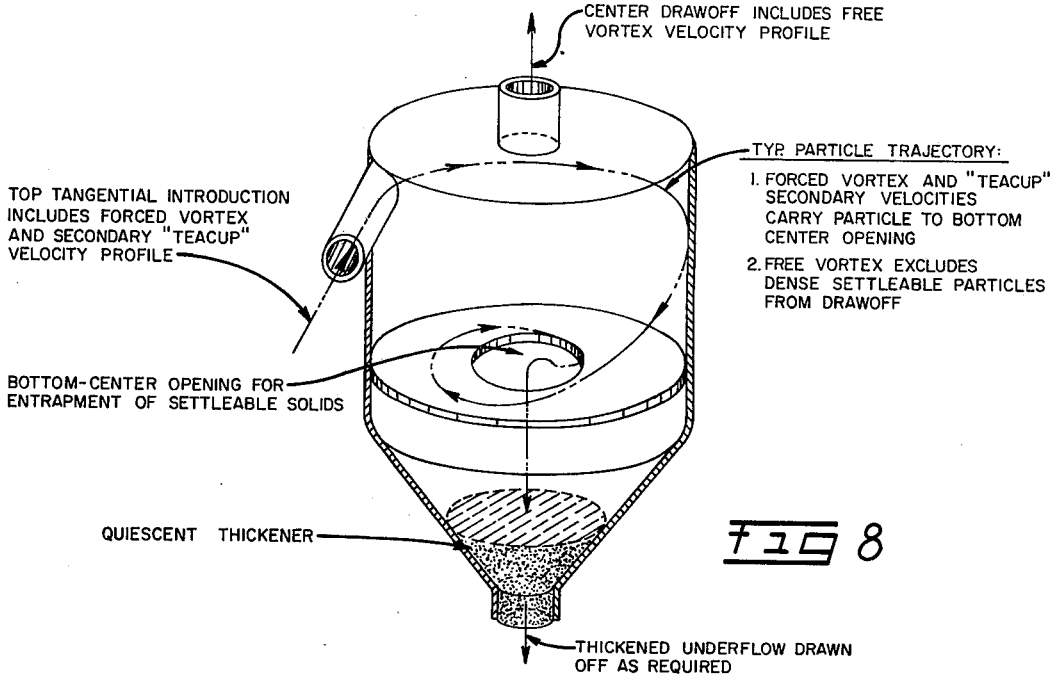
FIG 8
(FEATURES OF "TEACUP" SOLIDS SEPARATOR)
LEGEND
| SYMBOL | MATERIAL | SETTLING VELOCITY (mm/sec) |
|---|---|---|
| ▲ | SAND 1 | 208 |
| ○ | SAND 2 | 208 |
| ⬢ | SAND 3 | 217 |
| + | LEAD 1 | 693 |
| ● | LEAD 2 | 693 |
FIG 9
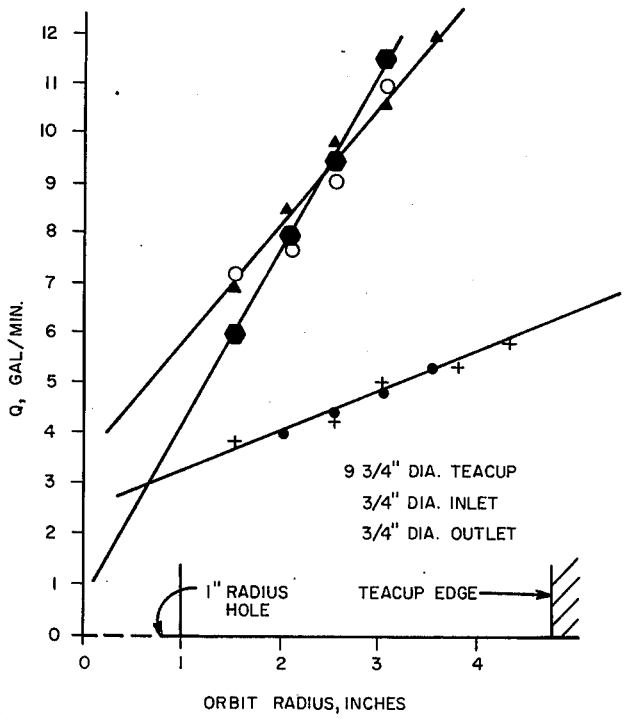
(STABLE PARTICLE ORBITS)

APPARATUS AND METHOD OF CLASSIFYING SOLIDS AND LIQUIDS

BACKGROUND OF THE INVENTION

Solid-liquid classification is a process widely utilized in water and wastewater treatment, in chemical industries, mining industries, and any industry utilizing or involving a process step in which materials suspended in a liquid medium must be separated from that liquid medium.

Exemplary of the types of apparatus employed are liquid cyclones which are commonly used for separating sand and other relatively high specific gravity material from water. Grit chambers have also long been utilized in the water and wastewater treatment fields for the separation of sand, and other readily settleable materials, from floatable materials which tend to remain suspended in the water medium. Mechanical centrifuges are also widely applied to solid-liquid mixtures for separating solid fractions from the liquid and producing a dense solid cake or slurry. Free vortex separators have been demonstrated to be extremely efficient devices for concentrating immiscible oils from water. In all these devices, advantage is taken of the specific gravity difference between the material to be removed, or classified, from that of the suspending liquid.

For additional background information reference may be had to *Perry's Chemical Engineer's Handbook,* 4th Edition, 1963 McGraw-Hill, or to other engineering texts on water and wastewater treatment or mass transfer unit processes.

SUMMARY OF THE INVENTION

The invention relates to a solid-liquid classification apparatus and method which can conveniently be used either in new construction or integrated in an existing fluid handling system with advantageous results.

It is an object of the invention to provide a solid-liquid classification apparatus and method in which the residence time is substantially less than in the equipment described above.

It is another object of the invention to provide a solid-liquid classification system which is capable of efficiently classifying materials having specific gravities greater than two times that of the suspending liquids from materials having specific gravities less that two times that of the suspending liquids.

It is a further object of the invention to provide a solid-liquid classification system in which high concentrations of solids are achievable in the classified material withdrawn from the apparatus, with the result that little or no further dewatering of the withdrawn classified solids is required for subsequent solids handling operations.

It is yet a further object of the invention to provide an apparatus and method which can further classify materials having specific gravities less than that of the suspending liquid from materials having specific gravities equal to or greater than the suspending liquids such that in a single process step, readily settleable solid materials and floatable materials can be efficiently and quickly removed from the suspending liquid.

It is still another object of the invention to provide a classification system in which classification can be achieved with energy requirements substantially less than those required by previous classification systems.

Another object of the invention is to provide a device and method which can hydraulically classify solid particles having specific gravities greater than two according to their size and specific gravity and with classification efficiencies heretofore unknown in hydraulic classification devices and methods.

It is an additional object of the invention to provide a classification system which is not only compact in size and economical to install but which is more economical to operate and maintain than classification systems heretofore known.

It is another additional object of the invention to provide a generally improved solid-liquid classification apparatus and method.

Other objects, together with the foregoing are attained in the embodiment described in the following description and illustrated in the accompanying drawings.

BRIEF DESCRIPTION OF THE DRAWINGS

FIG. 8 is a three-dimensional diagrammatic view showing various features of a "Teacup" solids separator of the invention, with portions of the drawing broken away to improve the disclosure;

FIG. 9 is a plot of the stable orbit diameters of particles having specific gravities greater than two as a function of their size, specific gravity, and the sweeping velocity current;

DETAILED DESCRIPTION OF PREFERRED EMBODIMENTS

Figure 1:
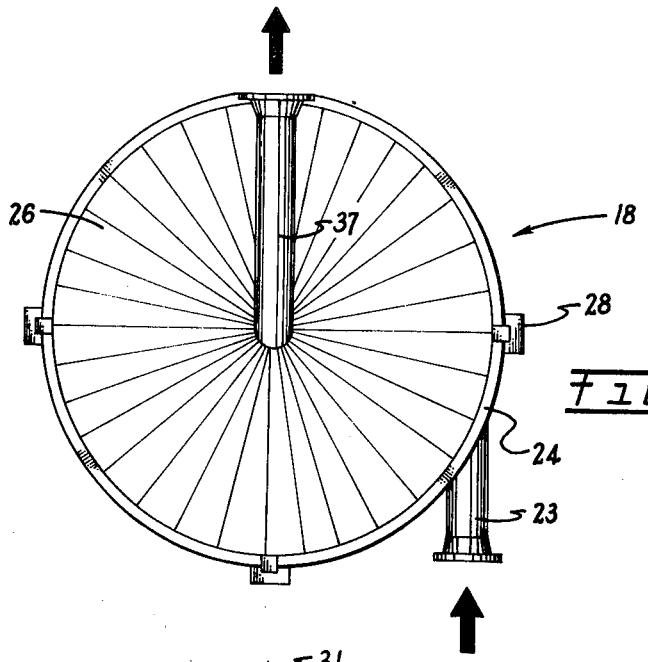
FIG. 1 is a top plan view of a solid-liquid classifier constructed pursuant to the invention.

Heretofore, solid-liquid classification devices have had to rely primarily on density differences between the suspending liquid, such as water, and the material to be separated from it, such as sand or immiscible oil, to achieve a hydraulic classification of material.

Certain hydraulic flow regimes have been utilized to magnify these density differences and therey improve the hydraulic classification efficiency of the units.

Examples of this are the hydraclone which sets up a rotational motion within a cylindrical chamber located above a downwardly tapering right circular cone from the bottom apex of which is withdrawn the heavier material having a specific gravity greater than water while the balance of flow exits through the top center of the unit free of the heavier material. Such swirling motion increases the centrifugal force on the particle having a specific gravity greater than that of the liquid and holds it against the wall of the chamber of the hydraclone.

In the case of immiscible oils, a device known as a free vortex oil-water separator reverses this effect and obtains a concentrated core of oil within the center of the unit which can be withdrawn separately from the suspending liquid.

The centrifuge is like the hydraclone except that the mechanical rotation of the fluid is imparted mechanically instead of hydraulically.

Grit chambers and sedimentation basins utilized in water and wastewater treatment for classification and separation of materials from waters likewise rely on density differences to separate these materials from the water. Such devices must be given a sufficient period of time to effect separation, however, since no external forces are applied to magnify the basic density difference. In other words, only gravitational forces are involved in these classification processes and as a consequence, lengthy time periods are ordinarily required to effect separation.

The manner in which the present invention differs from prior art solid-liquid classifiers can be observed in a teacup. After vigorously stirring the tea in a teacup containing loose tea leaves, the tea is allowed to rotate freely and the behavior of the tea leaves on the bottom of the teacup observed. Initially, immediately following the vigorous stirring, the tea leaves are dispersed throughout the tea. Following a brief period of time, however, the tea leaves will be found to be rotating in a circular path around the outer margin of the bottom of the teacup. Finally, as the circulation subsides further, the tea leaves begin progressively to move toward the bottom center of the teacup, so that when circulation has completely decayed the tea leaves will be piled neatly in the bottom center of the teacup.

Of the three stages of behavior of the tea leaves, it is the third, or last one, which is utilized by the present invention to effect a more efficient and economical classification of solids and immiscible liquids from a suspending liquid. For this reason, the word "Teacup" is sometimes used herein to designate the apparatus and method of the present invention.

The first stage, dispersion of the tea leaves, is characteristic of a device relying only on gravitational forces for the separation and classification of materials. Under these circumstances, particles move randomly, depending on the turbulence within the suspending liquid and in due course settle to the bottom, in a random pattern, under the force of gravity.

The second stage of the tea leaves, in which they circulate around the outer rim of the bottom of the teacup is characteristic of devices in which the specific gravity differences and magnified by centrifugal effects, such as occurs in hydraclones, free vortex separators, oil-water separators, centrifuges and the like. The particles are maintained in abutment with the peripheral wall by centrifugal force.

The final stage, however, in which the tea leaves migrate from the outer edge of the bottom of the teacup toward the center and then remain at the bottom center of the teacup is due to the predominance of induced secondary inwardly sweeping velocity effects on the particles over the centrifugal force effects resulting from the rotation of the particles. The manner in which the present invention utilizes the sweeping velocity in the classification of materials can be understood most clearly by reference to FIGS. 1-9.

To generate sweeping velocities, one form of classifier of the present invention, generally designated by the reference numeral 18, circulates fluid in a cylindrical classification chamber 21 over a flat bottom 22, thereby creating a sweeping velocity field over that bottom. As can be visualized from FIG. 1 and FIG. 2, this sweeping velocity field is established by introducing a relatively high velocity fluid stream through an inlet pipe 23 located tangentially at the upper end of a right circular cylindrical vessel 24 provided with a cover 26. The cylindrical vessel 24 is supported above the ground 27 by a plurality of legs 28 and defines not only the classification chamber 21 but also a right circular cylindrical quiescent chamber 29 below the classification chamber 21.

Communication between the upper classification chamber 21 and the lower quiescent chamber 29 is afforded by a circular central opening 30 in the bottom 22, the opening 30 being located on the longitudinal vertical axis 31 of the vessel. A circular baffle plate 32 is suspended below the opening 30 by suitable support rods 25 depending from the bottom 22 and improves the operation.

Below the cylindrical chamber 29 is a downwardly converging conical receptacle 33 at the bottom apex of which is located a valve 34, the receptacle 33 defining a conical chamber 25 serving to direct the collected solids downwardly for withdrawal through the valve 34 at desired intervals.

Figure 2:
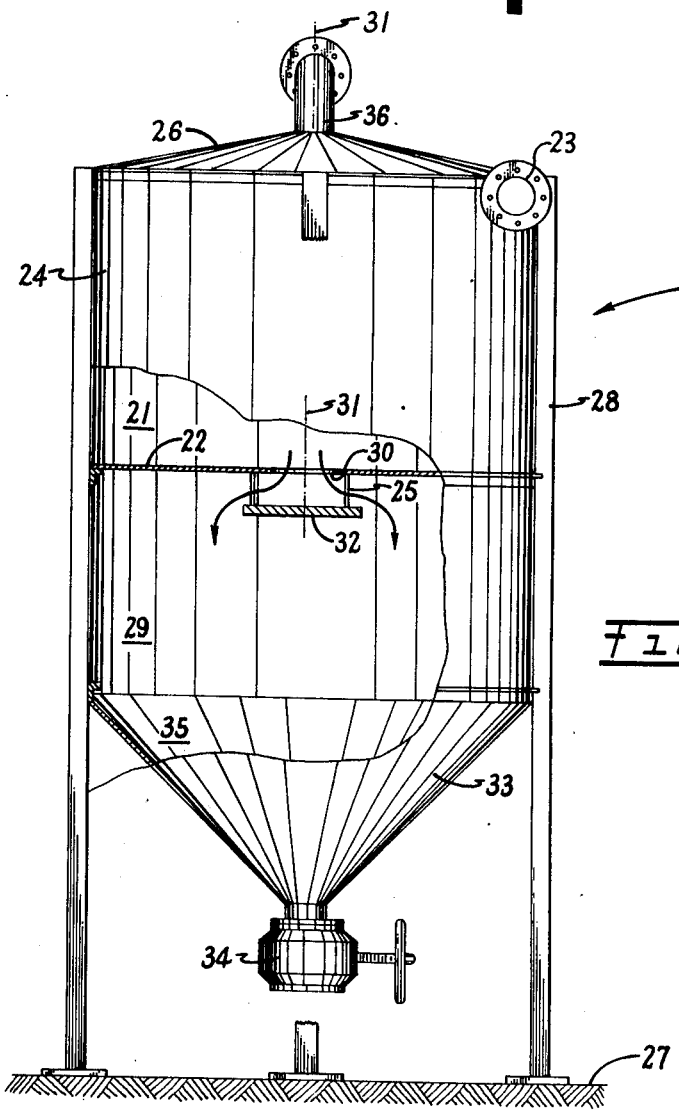
FIG. 2 is a side elevational view of the classifier of FIG. 1 with portions broken away to show the quiescent solids thickening zone located immediately below the classification chamber.
Figure 3:
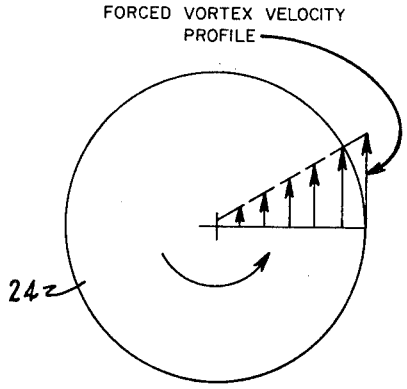
FIG. 3 is a top plan view of the tangential velocity profile developed within the classification chamber, showing schematically the forced vortex velocity profile extending from the periphery of the classification chamber to the central core of the classification chamber.

The tangential flow through the pipe 23 in a plane perpendicular to the axis 31 of the cylinder 24 and near the top of the upper chamber 21 as shown in FIGS. 1 and 2 effectively sets up a counterclockwise rotation of the liquid within the upper chamber 21 without disturbing the sweeping velocity pattern desired at the bottom 22 of the chamber 21. It is, furthermore, desired to stabilize the sweeping velocity currents at the base 22 of the chamber 21 as much as possible. This is accomplished by withdrawing liquid from the chamber 21 in an upward direction along the axis 31 of the cylinder, discharge taking place through a vertical outlet pipe 36 in the cover 26, the pipe 36 being connected to a horizontal section 37. Such a discharge condition effectively establishes the axis 31 of the cylinder as the center of rotation of the body of liquid, and thereby stabilizes the sweeping velocity patterns occurring at the bottom of the chamber 21, as appears diagrammatically in FIGS. 3 and 5.

Figure 4:
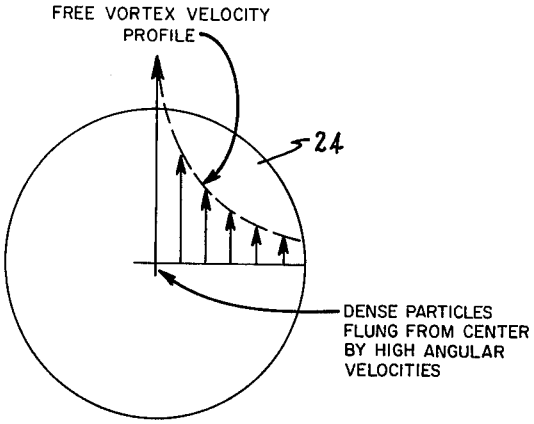
FIG. 4 is a top plan view comparable to FIG. 3 but showing a free vortex velocity profile.
Figure 6:
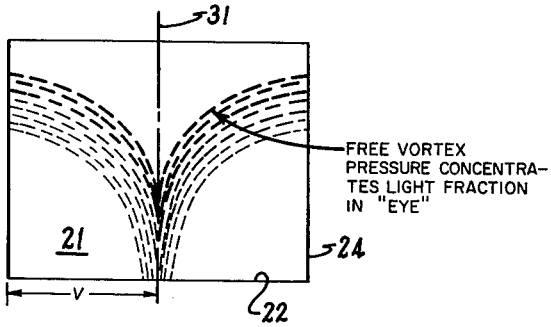
FIG. 6 is a side elevational view comparable to FIG. 5 but showing a free vortex velocity profile.

An ancillary effect of the upward axial discharge of fluid through the pipe 36 is the creation of a free vortex velocity profile within the center of the unit, as shown diagrammatically in FIGS. 4 and 6. In accordance with the principles of conservation of momentum (see pages 86–87, of Vennard, J. K., *Elementary Fluid Mechanics,* 3rd ed, 1954, John Wiley & Sons), with the reduction in pressure toward the central axis 31, an increase in angular velocity occurs exposing particles to increasing centrifugal forces as they proceed radially inwardly through the free vortex force field. Thus, the free vortex excludes dense settleable particles from the drawoff, resulting in a further degree of classification in a solid-liquid mixture. The large centrifugal force in the "eye" of the free vortex, in other words, hurls dense particles outwardly, thereby concentrating light fractions in the "eye" of the free vortex.

Figure 5:
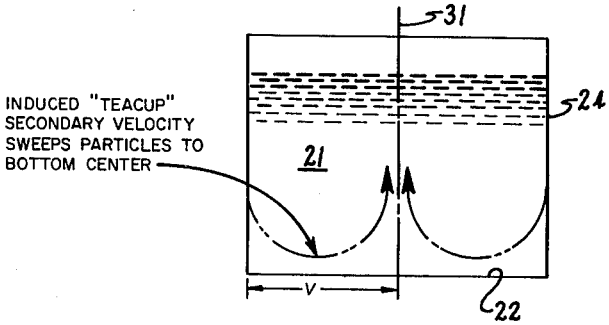
FIG. 5 is a side elevational view of the forced vortex profile within the body of the classification chamber showing schematically the induced secondary velocity profile.

As will be recognized, FIGS. 3–6 are diagrammatic in nature; and the free liquid surfaces shown in FIGS. 5 and 6 are for the purpose of illustrating, respectively, the secondary sweeping velocity induced by the forced vortex resulting from the inflow through a tangential pipe, for example, and the free vortex resulting from an axially downwardly drawoff of fluid.

In the apparatus shown in FIGS. 1 and 2 the chamber is filled with fluid. Thus, there is no free surface; and while the forced vortex in the classifier chamber 21 is caused by the tangential introduction of fluid through the pipe 23, the free vortex results from the upward withdrawal of fluid through the axial vertical pipe 36. Free vortex flow can occur, in other words, without a free surface (i.e. an air-liquid interface), and with upward drawoff as well as with the downward drain commonly associated with the creation of a vortex.

Figure 7:
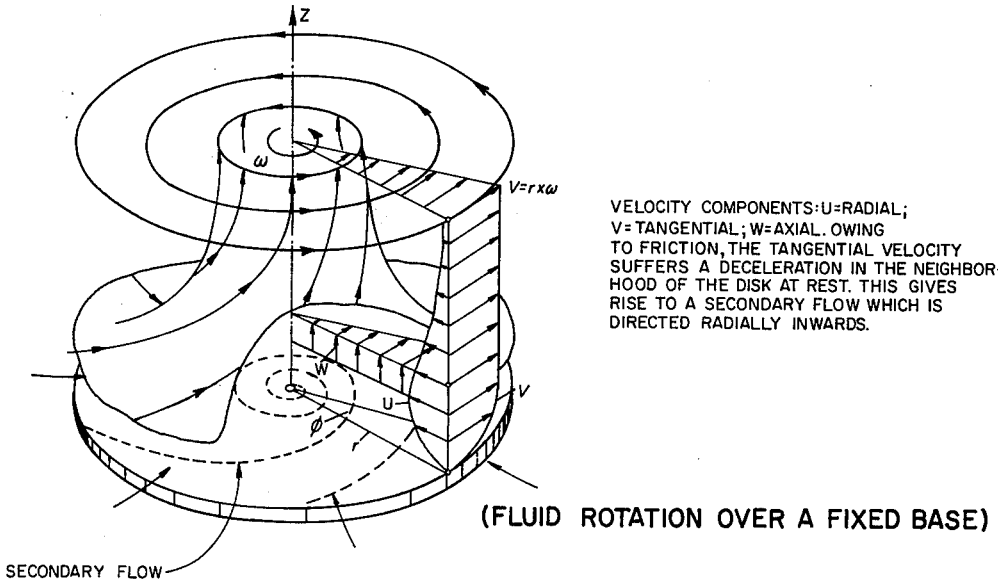
FIG. 7 is a three-dimensional diagrammatic view showing the velocity components which give rise to the secondary flow, or boundary-layer sweeping currents along the bottom of the classification chamber in accordance with the diagram on page 214 of Schlichting's *Boundary-Layer Theory,* 6th Edition, 1968, McGraw-Hill.

The two types of velocity profiles occurring within the unit 18 are diagrammatically illustrated in three dimensions in FIG. 7, a diagram taken fro Schlichting's *Boundary-Layer Theory.*

One velocity profile, characterized by a constant angular velocity of rotation $\omega$, omega, is termed a forced vortex flow condition, and in the invention is established by the tangential introduction of the solid-liquid mixture into the classification apparatus through the inlet pipe 23, as previously described.

The second velocity profile is characterized by constant angular momentum $\omega r^2$. The velocity profile is characteristic of a free vortex field.

The sweeping boundary layer flow at the bottom 22 of the right circular cylindrical chamber 21 resulting from the forced vortex flow patterns within the chamber 21 has been analyzed and discussed by Schlichting (supra). FIG. 7, as previously indicated, has been adapted from Schlichting and shows the secondary radially inward flow existing along the base of a body of liquid rotating in a right circular cylindrical chamber. Setteable particles entering this sweeping current flow field will experience two forces; namely, centrifugal force tending to throw the particles outwardly due to the rotation of the liquid, and a momentum force exerted by the sweeping current against the particle, tending to move the particle toward the bottom center of the unit.

Although the placement of the tangential pipe in FIG. 8 is opposite from that shown in FIGS. 1 and 2, and the helically radially diminishing flow pattern in FIG. 8 is opposite in sense from that illustrated in FIG. 7, several of the features of the "teacup" solids separator of the invention are disclosed in FIG. 8. Both the forced vortex (and the secondary induced flow) profile and the upward axial drawoff to provide a free vortex are shown.

The present invention differs from prior art classifiers in that in addition to the centrifugal force used by most of the previous classifiers to separate solid particles from the suspending liquid, the present device advantageously utilizes the momentum force of the secondary sweeping current, as well.

For a given particle dimension and specific gravity, as shown in FIG. 9, there has been found to exist a stable particle orbit along the base 22 of the right circular cylindrical chamber 21 under a given flow condition.

When these particles orbits tend to exceed the diameter of the chamber 21 or "teacup" as it is designated in FIG. 9, the unit no longer operates in accordance with the present invention but, rather, in accordance with the method practiced in the hydraclone or centrifuge types of solid-liquid classifiers wherein the particles are centrifugally held against the outer wall of the device and can only be removed by bringing these walls together in a right circular cone and by withdrawing an underflow stream containing the collected particles.

Conversely, there are conditions under which the sweeping velocity momentum so far exceeds the centrifugal forces acting on a particle that the particle's trajectory will not describe the stable orbits shown in FIG. 9 but will describe a spiral flow pattern which moves rapidly to the bottom center of the unit.

Thus, depending upon the particular sweeping flow conditions, the balance between the sweeping momentum forces, the sweeping velocity momentum forces and the centrifugal forces can effectively classify solid particles into three broad groups: (a) those which are swept into the bottom center of the unit and descend through the bottom opening 30 into the quiescent thickening chamber 29, or zone; (b) those which assume stable orbits along the base 22 of the chamber 21, and which consequently can be withdrawn from these orbits as required; and (c) those which tend to assume orbit diameters greater than the diameter of the unit and are therefore held against the outside wall of the classification chamber 21.

The present classifier 18 can be operated with or without the free vortex field schematically illustrated in FIGS. 4 and 6. When it is desirable to classify material having specific gravities greater than twice that of the suspending liquid (or to remove materials having specific gravities greater than twice that of the suspending liquids) from those having specific gravities less than twice that of the liquid, including immiscible oils and floatables, a free vortex condition can be developed within the unit as is done in conventional oil-water separators in order effectively to concentrate these materials in the "core" of the free vortex and then withdraw the core material separately from the remaining liquid stream.

Figure 10:
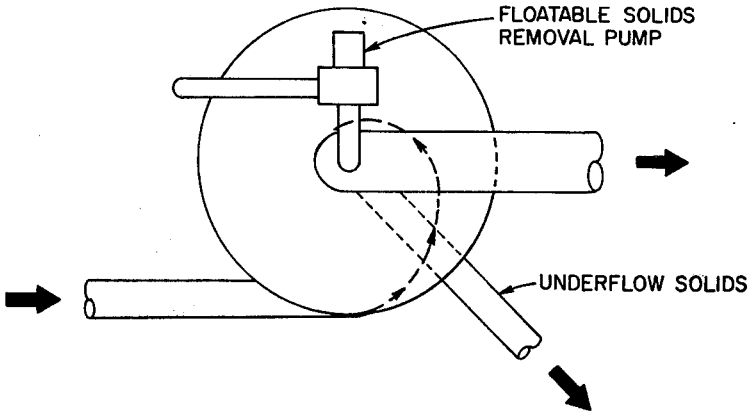
FIG. 10 is a diagrammatic top plan view of a solids-liquid classification apparatus as applied in the classification of both settleable and floatable materials from the suspending liquid.
Figure 11:
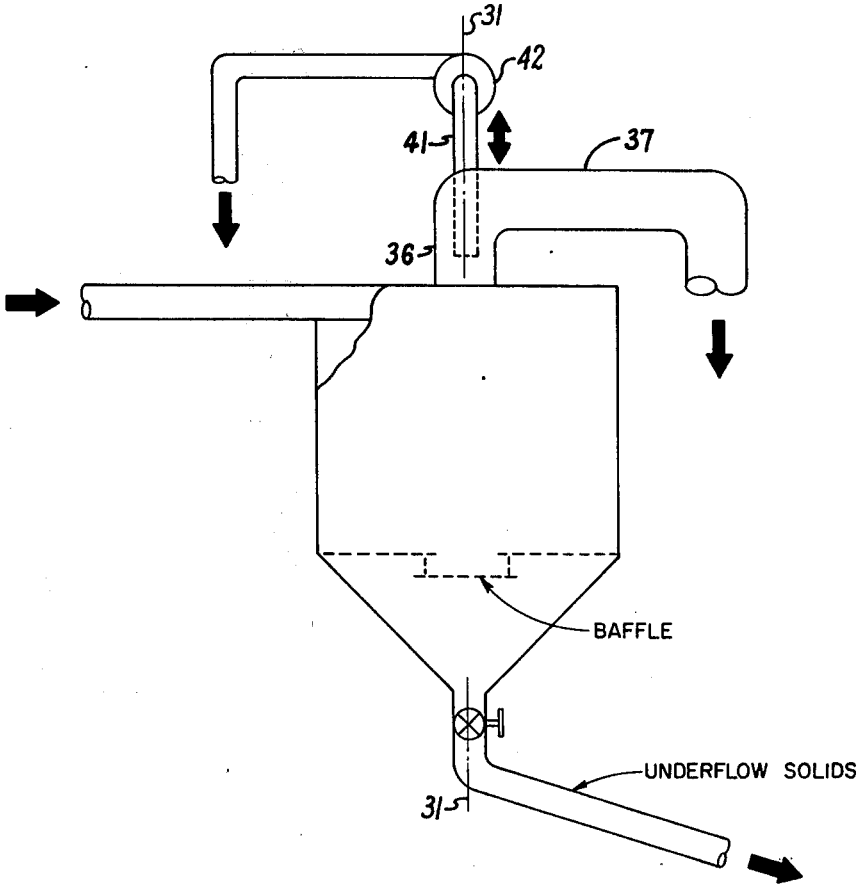
FIG. 11 is a side elevational view of the apparatus shown in FIG. 10.
Figure 12:
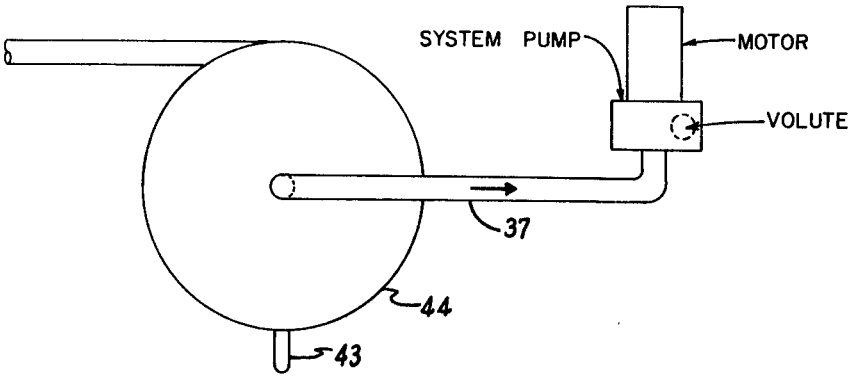
FIG. 12 is a diagrammatic top plan view of a solid-liquid classifier pursuant to the invention which is designed to classify hydraulically settleable materials, such as minerals, according to size and specific gravity.
Figure 13:
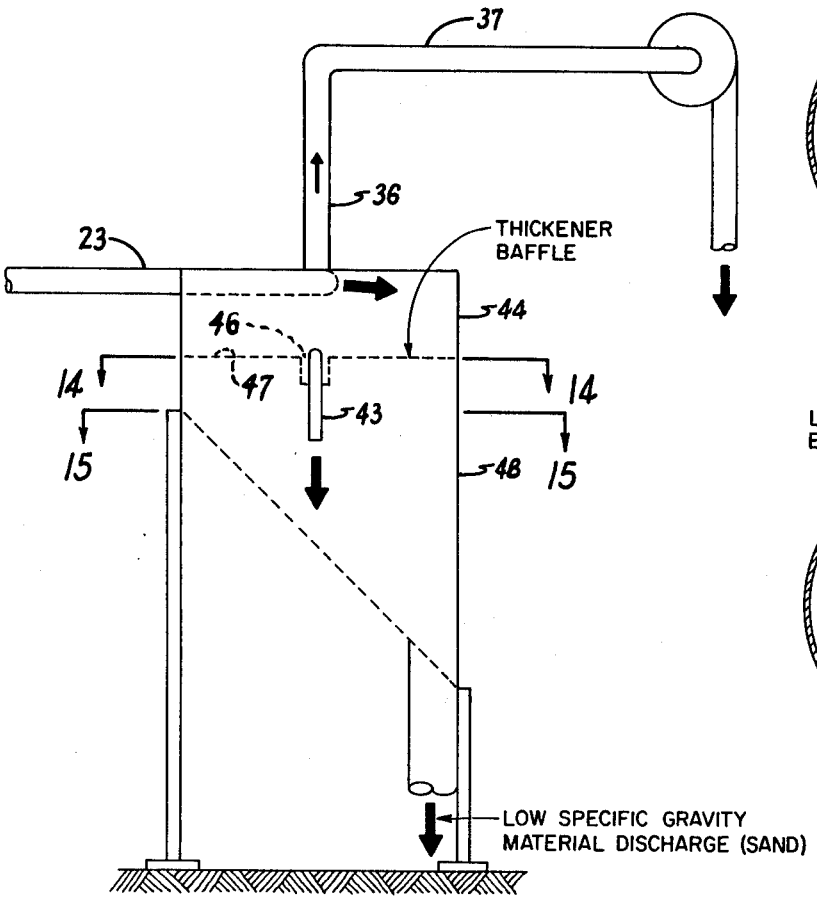
FIG. 13 is a side elevational view of the apparatus shown in FIG. 12.
Figure 14:
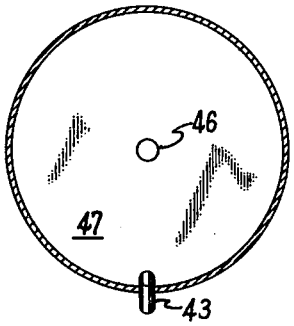
FIG. 14 is a sectional view taken on the line 14—14 in FIG. 13.
Figure 15:
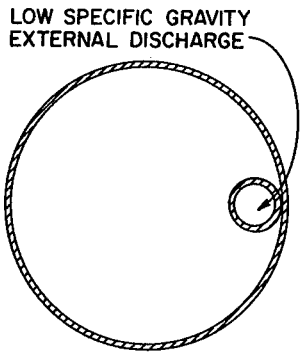
FIG. 15 is a sectional view taken on the line 15—15 in FIG. 13.

A preferred embodiment for accomplishing this objective is illustrated in FIGS. 10 and 11. A vertically positionable tube 41 is placed on the axis 31 within the discharge pipe 36 of the unit shown in FIGS. 1 and 2, and by means of a pump 42 a fluid stream is withdrawn through this floatable tube 41 in accordance with the degree of free vortex conditions sought. Consequently, materials having specific gravities of less than twice the suspending liquid can be drawn into the free vortex core and thence withdrawn through the floatable tube 41 to a subsequent treatment stage for further classification and/or treatment. The operation of the floatable tube 41 in no way alters or impairs the performance and operation of the solid-liquid classification system as described above and illustrated in FIGS. 1 and 2.

FIGS. 12–15 illustrate a preferred embodiment of apparatus for the separate classification of materials having specific gravities greater than twice that of the suspending liquids. This unit differs from the basic apparatus illustrated in FIGS. 1 and 2 in that one or more draw points, for example pipe 43, at the periphery of the right circular cylindrical vessel 44 is provided to intercept particles in which centrifugal forces exceed sweeping velocity momentum forces, i.e., the high specific gravity materials. All low specific gravity materials are swept to the bottom center of the unit and are discharged through a central opening 46 in the bottom 47 into the quiescent thickener cylinder 48. Intermediate materials are retained on the bottom 47 of the right circular cylinder 44 and (a) can be subsequently withdrawn at the periphery of the cylinder by increasing the centrifugal forces through increasing the through-put flow rate or, (b) can be swept to the bottom center and into the quiescent zone by increasing the sweeping velocity forces relative to the centrifugal forces. Such an apparatus finds application in the separation recovery of gold and other high specific gravity minerals from the sands and gravels normally found in conjunction with them.

The performance of the present invention as a classification unit for the separation of setteable soils from water was evaluated in parallel with other alternative systems to determine its relative efficiency. The results of this analysis have been summarized in the following Table 1.

| | Type of Device | | |
|---|---|---|---|
| Type of Soil | Solid-liquid Classifier | Swirl Concentrator | Cyclone |
| Yolo Loam Soil | 95 | 15 | 10 |
| Silt Soil | 98 | — | 75 |

It will be noted that of the soil solids introduced into these various units operating under identical flow rates, the classifier of the present invention recovered 95% of the fine loam type soil (Yolo Loam) whereas 90% was passed by the cyclonic type device; and in a silt type of soil, there was substantially no carry over of soil solids in the present classifier whereas 25% was carried over by the cyclone.

When applied as a classifier for the separation of settleable soils from an industrial process water, the unit removed 95% of the soil contained in the wastewater and more importantly, produced a slurry solids concentration of 75%. Unlike conventional hydraclones, the present invention does not require a hydraulic underflow to carry solids from the unit as it utilizes the sweeping velocities to accomplish this effect. As a result, solids can be maximum solids concentrations.

Still other tests have indicated that the solid-liquid classifier of the invention also lends itself very advantageously to the treatment and disposal of storm water flows, for example. Owing to the unit's compact size, it can be easily accommodated to storm water flows and effect a miaximum degree of separtion of floatable and settleable materials from the storm water, routing these polluting materials to appropriate treatment facilities for subsequent treatment. The treated storm water from the unit, free of settleable and floatable materials can then be safely discharged to surface waters with a greatly reduced pollutional load.

As a consequence of the quite different properties of the forced vortex and the free vortex force fields and the ability independently to regulate each within the solid-liquid classifier, it is possible to effect substantially complete separation of solid particles and immiscible oils from the classifier's final discharge.

The present method and apparatus, in summary, are not only versatile, is being readily adaptable for use in different environments and with materials of widely variant properties, but are also efficient, reliable and economical.

What is claimed is:

1. An apparatus for classifying suspended materials and suspending liquids comprising:

a. a right circular cylindrical vessel including a substantially flat bottom having an opening in the center thereof, side walls extending upwardly from said bottom, and a top cover forming with said bottom and said side walls a classifier chamber having a central vertical axis;

b. inlet means communicating with said classifier chamber for establishing therein a forced vortex of the liquid and the material, said inlet means including an inlet pipe directed tangentially through said side walls adjacent the top of said classifier chamber;

c. outlet means communicating with said classifier chamber for removing excess liquid therefrom, said outlet means including a discharge conduit; and, d. a receptacle forming a quiescent chamber below said vessel, said quiescent chamber being in communication with said central opening in said classifier chamber for receiving the material swept toward said central opening by the radially inward secondary currents induced by the forced vortex and urged downwardly by gravity through said central opening into said quiescent chamber.

2. An apparatus as in claim 1 including means communicating with said quiescent chamber for selectively removing the material accumulated therein.

3. An apparatus as in claim 1 in which said discharge conduit is mounted on the highest point on said top cover enabling floatable material in said classifier chamber to exit through said discharge conduit with the excess liquid.

4. An apparatus as in claim 3 in which said vertical axis of said classifier chamber intersects the highest point of said top cover, the flow of liquid exiting from said classifier chamber into said discharge conduit being effective to establish a vertical free vortex within said classifier chamber symmetrical about said vertical axis, the free vortex being capable of concentrating relatively light material having a specific gravity less than the specific gravity of the liquid in the "eye" of the free vortex for removal of the relatively light material through said discharge conduit.

5. A method of classifying suspended materials and suspending liquids including the steps of:

a. providing a hollow, covered, right circular cylindrical vessel having a top cover and a bottom defining a classifier chamber with the longitudinal axis in vertical attitude;

b. introducing the liquid and suspended material tangentially into the classifier chamber adjacent the upper end thereof to establish a forced vortex having a velocity such that the flow regime in the classifier chamber in dominated by secondary induced currents flowing across the bottom of the classifier chamber with radially inward sweeping components effective to accumulate material at the bottom center thereof;

c. removing the accumulated material from the bottom of the classifier chamber;

d. withdrawing the excess liquid from the top of the classifier chamber through an opening in the top cover on the vertical axis of the classifier chamber to establish a free vortex located on the vertical axis; and, e. removing any floatable material from the "eye" of the free vortex.

6. A method of classifying suspended materials and suspending liquids as in claim 5 including the steps of varying the velocity of the forced vortex in order to shift domination of the flow regime as between the radially inward sweeping forces exerted by the secondary induced currents and the radially outward centrifugal forces exerted by the vortex currents.

7. A method as in claim 5 in which the flow velocity in the forced vortex is at least equal to the velocity required to impel material located adjacent said bottom against said side walls by centrifugal force.

8. A method as in claim 5 in which the respective flow velocities cause the material located adjacent said bottom to move in orbits having predetermined radii in dependence upon the specific gravity and settling velocity of the material relative to said flow velocities.

9. A method as in claim 8 including removing from said chamber material revolving in the respective one of said orbits.

* * * * *